US009254656B2

(12) United States Patent
Okui et al.

(10) Patent No.: US 9,254,656 B2
(45) Date of Patent: Feb. 9, 2016

(54) LIQUID EJECTING HEAD, LIQUID EJECTING APPARATUS, AND MANUFACTURING METHOD OF LIQUID EJECTING HEAD

(71) Applicant: SEIKO EPSON CORPORATION, Tokyo (JP)

(72) Inventors: Hiroaki Okui, Azumino (JP); Isamu Togashi, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/794,397

(22) Filed: Jul. 8, 2015

(65) Prior Publication Data

US 2016/0009087 A1 Jan. 14, 2016

(30) Foreign Application Priority Data

Jul. 11, 2014 (JP) ..... 2014-143538

(51) Int. Cl.

| | |
|---|---|
| ***B41J 2/14*** | (2006.01) |
| ***B41J 2/16*** | (2006.01) |
| ***H01R 12/70*** | (2011.01) |
| ***B41J 2/175*** | (2006.01) |

(52) U.S. Cl.

CPC ..... *B41J 2/1433* (2013.01); *B41J 2/14072* (2013.01); *B41J 2/162* (2013.01); *B41J 2/17526* (2013.01); *H01R 12/7076* (2013.01); *B41J 2002/14491* (2013.01)

(58) Field of Classification Search

CPC ..... B41J 2/1433; B41J 2/162; B41J 2/14072; B41J 2/17526; B41J 2/14201; B41J 2/14233; B41J 2/1607; B41J 2/1612

See application file for complete search history.

(56) References Cited

U.S. PATENT DOCUMENTS

| | | | | |
|---|---|---|---|---|
| 8,210,656 | B2 * | 7/2012 | Suzuki | B41J 2/14233 347/50 |
| 8,376,517 | B2 * | 2/2013 | Okubo | B29C 70/80 347/44 |

FOREIGN PATENT DOCUMENTS

| | | | |
|---|---|---|---|
| JP | 2009-119667 | A | 6/2009 |
| JP | 2012-081644 | A | 4/2012 |
| JP | 2013-103429 | A | 5/2013 |

* cited by examiner

*Primary Examiner* — Juanita D Jackson

(74) *Attorney, Agent, or Firm* — Workman Nydegger

(57) ABSTRACT

A liquid ejecting head includes a basic wiring board which includes a first connection region and a second connection region, a plurality of head units, and a plurality of individual wiring boards each of which includes a first connection portion, a relay portion, and a second connection portion, and electrically connects the basic wiring board and each head unit, in which the second connection portion of an individual wiring board is fixed to the first connection region by being bent to the second connection region side, the second connection portion of an individual wiring board is fixed to the second connection region by being bent to the first connection region side, and an interval between the relay portions of the two individual wiring boards is large on the basic wiring board side compared to the head unit side.

16 Claims, 14 Drawing Sheets

PROCESS P2

PROCESS P3

PROCESS P4

PROCESS P5

LIQUID EJECTING HEAD, LIQUID EJECTING APPARATUS, AND MANUFACTURING METHOD OF LIQUID EJECTING HEAD

CROSS-REFERENCE TO RELATED APPLICATIONS

This application claims priority to Japanese Patent Application No. 2014-143538 filed on Jul. 11, 2014. The entire disclosure of Japanese Patent Application No. 2014-143538 is hereby incorporated herein by reference.

BACKGROUND

1. Technical Field

The present invention relates to a technology for ejecting liquid such as ink.

2. Related Art

A liquid ejecting head with a configuration in which a plurality of head units which eject liquid such as ink from a plurality of nozzles are arranged is proposed in the related art. Each of the plurality of head units is connected to a wiring board which supplies a control signal or a driving signal, for example, and is operated when receiving a supply of a control signal or a driving signal from the wiring board. In JP-A-2012-81644, a configuration in which a head unit and a relay board (rigid board) are electrically connected through two chip on film (COF) boards is disclosed. Specifically, one end of each COF board is bonded to a head unit, and on the other hand, the other end of the COF board is bonded onto the surface of a wiring board.

In a technology in JP-A-2012-81644, an end portion of one COF board in two COF boards which form a pair is bonded to a relay board in a state of being bent to a side opposite (outer side) to the other COF board. Accordingly, it is necessary to secure a wide space for forming wiring which is connected to the COF board on a side opposite to the other COF board of the surface of the relay board by interposing each COF board therebetween. However, for example, when assuming a case in which a plurality of head units are arranged in a state of being close to each other, it is practically difficult to secure an enough space for wiring on the outer side of the pair of COF boards on the surface of the relay board.

SUMMARY

An advantage of some aspects of the invention is to reduce a space for wiring which is necessary on the outer side of a pair of connection regions in which a flexible wiring board among wiring boards is bonded.

Aspect 1

According to a preferred aspect (Aspect 1) of the present invention, there is provided a liquid ejecting head which includes a basic wiring board which includes a first connection region and a second connection region which extend in a first direction with an interval therebetween; a plurality of head units which face the basic wiring board, and eject liquid on a side opposite to the basic wiring board; and a plurality of flexible individual wiring boards each of which includes a first connection portion, a second connection portion, and a relay portion which is located between the first connection portion and the second connection portion, and electrically connects the basic wiring board and each of the head units, in which, in a first individual wiring board among the plurality of individual wiring boards, the first connection portion is connected to a first head unit among the plurality of head units, the second connection portion which is bent to the second connection region side with respect to the relay portion is connected to the first connection region of the basic wiring board, and in a second individual wiring board among the plurality of individual wiring boards, the first connection portion is connected to a second head unit among the plurality of head units, the second connection portion which is bent to the first connection region side with respect to the relay portion is fixed to the second connection region of the basic wiring board, and an interval between a boundary between the second connection portion and the relay portion in the first individual wiring board, and a boundary between the second connection portion and the relay portion in the second individual wiring board exceeds an interval between a boundary between the first connection portion and the relay portion in the first individual wiring board, and a boundary between the first connection portion and the relay portion in the second individual wiring board. With the above configuration, the second connection portion of the first individual wiring board is fixed to the first connection region in a state of being bent to the second connection region side, and the second connection portion of the second individual wiring board is fixed to the second connection region in a state of being bent to the first connection region side. That is, the first individual wiring board and the second individual wiring board are bonded to the basic wiring board so that a tip end portion of the second connection portion of the first individual wiring board, and a tip end portion of the second connection portion of the second individual wiring board face each other. Accordingly, it is not necessary to secure a wide space for forming wiring of each individual wiring board in a region on a side opposite to the other side by interposing one of the first connection region and the second connection region in the basic wiring board therebetween, and it is possible to miniaturize the liquid ejecting head. In addition, the interval between the boundary between the second connection portion and the relay portion in the first individual wiring board, and the boundary between the second connection portion and the relay portion in the second individual wiring board is larger than the interval of the boundary between the first connection portion and the relay portion in the first individual wiring board, and the boundary between the first connection portion and the relay portion in the second individual wiring board. That is, in the intervals between the relay portions of the first individual wiring board and the second individual wiring board, the interval on the basic wiring board side is large compared to each head unit side. Accordingly, when compared to a configuration in which the relay portions of the first individual wiring board and the second individual wiring board are parallel to each other (for example, configuration in which both relay portions of first individual wiring board and second individual wiring board extend along direction which is perpendicular to basic wiring board), there is an advantage that it is possible to arrange the plurality of head units by reducing intervals therebetween (can be arranged at high density) while securing an enough space between the first connection region and the second connection region, regardless of the configuration in which the second connection portions of the first individual wiring board and the second individual wiring board face each other.

Aspect 2

In the liquid ejecting head according to a preferred example (Aspect 2) of Aspect 1, in the first individual wiring board, the second connection portion which is bent to the basic wiring board side along an outer peripheral edge of the basic wiring board may be connected to the first connection region of the basic wiring board, and in the second individual wiring board, the second connection portion which is inserted into an insertion port which is formed on the basic wiring board, and is bent along an inner peripheral edge of the insertion port may be connected to the second connection region of the basic wiring board. In the aspect, in the first individual wiring board, the second connection portion which is bent along the outer peripheral edge of the basic wiring board is connected to the first connection region, and in the second individual wiring board, the second connection portion which is inserted into the insertion port of the basic wiring board, and is bent along the inner peripheral edge of the insertion port is connected to the second connection region. Accordingly, when compared to a configuration in which both the first individual wiring board and the second individual wiring board are connected to the basic wiring board by being inserted into the insertion port, the total number of the insertion ports which are formed on the basic wiring board is reduced. Accordingly, there is an advantage that it is possible to maintain mechanical strength of the basic wiring board, and to efficiently use a space on the basic wiring board.

Aspect 3

In the liquid ejecting head according to a preferred example (Aspect 3) of Aspect 2, in a third individual wiring board which is located on a side opposite to the first individual wiring board by interposing the second individual wiring board among the plurality of individual wiring boards therebetween, the first connection portion may be connected to a third head unit among the plurality of head units, and the second connection portion which is inserted into another insertion port which is formed on the basic wiring board separately from the insertion port, and is bent to a side opposite to the second individual wiring board along an inner peripheral edge of another insertion port may be connected to the basic wiring board. In the aspect, in the third individual wiring board which is located on the side opposite to the first individual wiring board by interposing the second individual wiring board therebetween, the first connection portion is connected to the third head unit, and the second connection portion is connected to the basic wiring board by being bent to the side opposite to the second individual wiring board along the inner peripheral edge of the insertion port by being inserted into the insertion port which is formed on the basic wiring board separately from the insertion port into which the second individual wiring board is inserted. That is, the third individual wiring board is inserted into an insertion port which is different from that in the second individual wiring board among the insertion ports which are formed on the basic wiring board. According to the aspect, there is an advantage that it is possible to prevent the second individual wiring board from being in contact with the third individual wiring board compared to a configuration in which the second individual wiring board and the third individual wiring board are inserted into a common insertion port.

Aspect 4

In the liquid ejecting head according to a preferred example (Aspect 4) of Aspect 2, in a third individual wiring board which is located on a side opposite to the first individual wiring board by interposing the second individual wiring board among the plurality of individual wiring boards therebetween, the first connection portion may be connected to a third head unit among the plurality of head units, and the second connection portion which is inserted into the insertion port which is common to that of the second individual wiring board, and is bent to the side opposite to the second individual wiring board along an inner peripheral edge of the insertion port on the side opposite to the second individual wiring board may be connected to the basic wiring board. In the aspect, in the third individual wiring board which is located on the side opposite to the first individual wiring board by interposing the second individual wiring board therebetween, a first connection portion is connected to the third head unit, and a second connection portion of the third individual wiring board is inserted into an insertion port which is common to that of the second individual wiring board, and is connected to the basic wiring board by being bent to a side opposite to the second individual wiring board along an inner peripheral edge on a side opposite to the second individual wiring board. That is, the second individual wiring board and the third individual wiring board has a common insertion port. Accordingly, it is possible to reduce the total number of insertion ports which are formed on the basic wiring board compared to a configuration in which the second individual wiring board and the third individual wiring board are connected to the second connection region on the basic wiring board by being inserted into a separate insertion port which is formed on the basic wiring board. Accordingly, there is an advantage that it is possible to maintain mechanical strength of the basic wiring board, and to efficiently use a space on the basic wiring board.

Aspect 5

In the liquid ejecting head according to a preferred example (Aspect 5) of any one of Aspect 1 to Aspect 4, in the first individual wiring board which is located on one end portion side in a direction in which the plurality of individual wiring boards are aligned, the second connection portion which is bent along a first outer peripheral edge of the basic wiring board may be connected to the first connection region of the basic wiring board, and in a fourth individual wiring board which is located on the other end portion side in the direction in which the plurality of individual wiring boards are aligned, the second connection portion which is bent to the first outer peripheral edge side along a second outer peripheral edge on a side opposite to the first outer peripheral edge of the basic wiring board may be connected to a connection region of the basic wiring board. In the aspect, in the first individual wiring board which is located on the one end portion side in the direction in which the plurality of individual wiring boards are aligned, the second connection portion is bent along the first peripheral outer edge of the basic wiring board, and in the fourth individual wiring board which is located on the other end portion side in the direction in which the plurality of individual wiring boards are aligned, the second connection portion is bent to the first outer peripheral edge side along the second outer peripheral edge on the side opposite to the first outer peripheral edge in the basic wiring board. That is, the second connection portion of the first individual wiring board which is located on one side of the individual wiring board, and the second connection portion of the fourth individual wiring board which is located on the other side of the individual wiring board face each other. Accordingly, it is not necessary to secure a wide space for forming wiring in a region on the side opposite to the side on which the second connection portions of the first individual wiring board and the fourth individual wiring board are bent. According to the aspect, there is an advantage that it is possible to efficiently use a space on the basic wiring board, and to miniaturize the liquid ejecting head compared to a configuration in which the second connection portion of the first individual wiring board and the second connection portion of the fourth individual wiring board face each other's opposite sides.

Aspect 6

According to another preferred aspect (Aspect 6) of the invention, there is provided a liquid ejecting head which includes a basic wiring board which includes a plurality of connection regions which extend in a first direction with intervals therebetween; a plurality of head units which face the basic wiring board, and eject liquid on a side opposite to the basic wiring board; and a plurality of flexible individual wiring boards each of which includes a first connection portion, a second connection portion, and a relay portion which is located between the first connection portion and the second connection portion, and electrically connects the basic wiring board and each of the head units, in which, in a first individual wiring board which is located on one end portion side in a direction in which the plurality of individual wiring boards are aligned, the second connection portion which is bent along a first outer peripheral edge of the basic wiring board is connected to a first connection region of the basic wiring board, and in a fourth individual wiring board which is located on the other end portion side in the direction in which the plurality of individual wiring boards are aligned, the second connection portion which is bent to the first outer peripheral edge side along a second outer peripheral edge on a side opposite to the first outer peripheral edge of the basic wiring board is connected to a connection region of the basic wiring board. With such a configuration, in the first individual wiring board which is located on one end portion side in the direction in which the plurality of individual wiring boards are aligned, the second connection portion is bent along the first outer peripheral edge of the basic wiring board, and in the fourth individual wiring board which is located on the other end portion side in the direction in which the plurality of individual wiring boards are aligned, the second connection portion is bent to the first outer peripheral edge side along the second outer peripheral edge on the side opposite to the first outer peripheral edge of the basic wiring board. That is, the second connection portion of the first individual wiring board which is located on one side of the individual wiring board, and the second connection portion of the fourth individual wiring board which is located on the other side of the individual wiring board face each other. Accordingly, it is not necessary to secure a wide space for forming wiring in a region on the side opposite to the side on which the second connection portions of the first individual wiring board and the fourth individual wiring board are bent. According to the configuration, there is an advantage that it is possible to efficiently use a space on the basic wiring board, and to miniaturize the liquid ejecting head compared to a configuration in which the second connection portion of the first individual wiring board and the second connection portion of the fourth individual wiring board face each other's opposite sides.

Aspect 7

In the liquid ejecting head according to a preferred example (Aspect 7) of Aspect 5 or Aspect 6, a concave portion for accommodating the first individual wiring board may be formed in the first outer peripheral edge. In the aspect, the first individual wiring board which is located on one end portion side in the individual wiring board is accommodated in the concave portion which is formed on the first outer peripheral edge of the basic wiring board, and the second connection portion of the first individual wiring board is bent along the first outer peripheral edge, and is connected to the connection region of the basic wiring board. That is, the first individual wiring board is accommodated in the concave portion of the first outer peripheral edge of the basic wiring board. Accordingly, there is an advantage that it is possible to secure an accuracy of bonding between the first individual wiring board and the basic wiring board, compared to a configuration in which a concave portion is not formed on the first outer peripheral edge of the basic wiring board (configuration in which first individual wiring board is not bent along first outer peripheral edge).

Aspect 8

According to still another preferred aspect (Aspect 8) of the invention, there is provided a liquid ejecting apparatus which includes the liquid ejecting head according to any one of the Aspects 1 to 7. A preferable example of the liquid ejecting head is a printing apparatus which ejects ink; however, usage of the liquid ejecting apparatus according to the aspect of the invention is not limited to printing.

Aspect 9

The liquid ejecting head according to any one of the Aspects 1 to 7 is manufactured using a method related to an aspect (Aspect 9) which will be exemplified below, for example. According to still another preferred aspect (Aspect 9) of the invention, there is provided a manufacturing method which includes holding a second connection portion of a first individual wiring board using a first holding tool from a side opposite to a plurality of head units by interposing a basic wiring board therebetween; relatively moving the basic wiring board by a first movement amount to a first side in a direction in which the plurality of head units are aligned in a state in which the second connection portion of the first individual wiring board is held using the first holding tool; holding a second connection portion of a second individual wiring board using a second holding tool from a side opposite to the plurality of head units by interposing the basic wiring board therebetween after the basic wiring board is relatively moved; relatively moving the basic wiring board by a second movement amount which is smaller than the first movement amount to a second side which is opposite to the first side in a direction in which the plurality of head units are aligned, in a state in which the second connection portion of the first individual wiring board is held using the first holding tool, and the second connection portion of the second individual wiring board is held using the second holding tool; causing the basic wiring board and the plurality of head units to be close to each other; and connecting each of the second connection portions of the first individual wiring board and the second individual wiring board to the basic wiring board by releasing holding using the first and second holding tools, after causing the basic wiring board and the plurality of head units to be close to each other. According to the above described manufacturing method, it is possible to connect the first individual wiring board and the second individual wiring board to the basic wiring board so that an interval is enlarged on the basic wiring board side, compared to the side of each of the head units using a simple process.

Aspect 10

In the manufacturing method according to a preferred example (Aspect 10) of Aspect 9, a guiding unit of which an interval into which the first individual wiring board is inserted becomes large toward a tip end of the first holding tool may be formed on the tip end side. In the aspect, there is an advantage that holding of the first individual wiring board using the first holding tool becomes easy, since the first individual wiring board is guided along an inclined face of the guiding unit.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
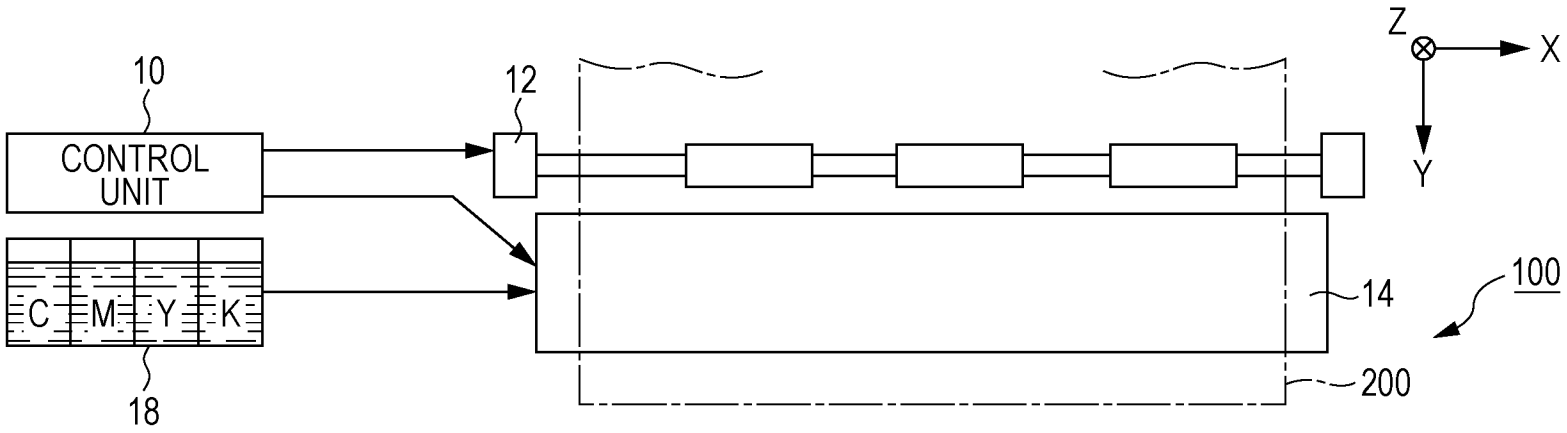
FIG. 1 is a configuration diagram of a printing apparatus according to an embodiment of the invention.

FIG. 1 is a partial configuration diagram of an ink jet printing apparatus 100 according to a preferable embodiment of the invention. The printing apparatus 100 according to the embodiment is a liquid ejecting apparatus which ejects ink as an example of liquid to a printing medium (ejection target) 200 such as a printing sheet, and includes a control unit 10, a transport mechanism 12, and a liquid ejecting module 14. A liquid container (ink cartridge) 18 which stores ink of a plurality of colors is mounted on the printing apparatus 100. According to the embodiment, ink of four colors of cyan (C), magenta (M), yellow (Y), and black (B) are stored in the liquid container 18.

The control unit 10 integrally controls each element of the printing apparatus 100. The transport mechanism 12 transports the printing medium 200 in the Y direction under a control of the control unit 10. The liquid ejecting module 14 ejects ink which is supplied from the liquid container 18 to the recording medium 200 under a control of the control unit 10. The liquid ejecting module 14 according to the embodiment is a line head module which is long in the X direction intersecting the Y direction. In addition, hereinafter, a direction which is perpendicular to an X-Y plane (plane which is parallel to surface of printing medium 200) is denoted by a Z direction. An ejecting direction of ink using the liquid ejecting module 14 corresponds to the Z direction.

Figure 2A:
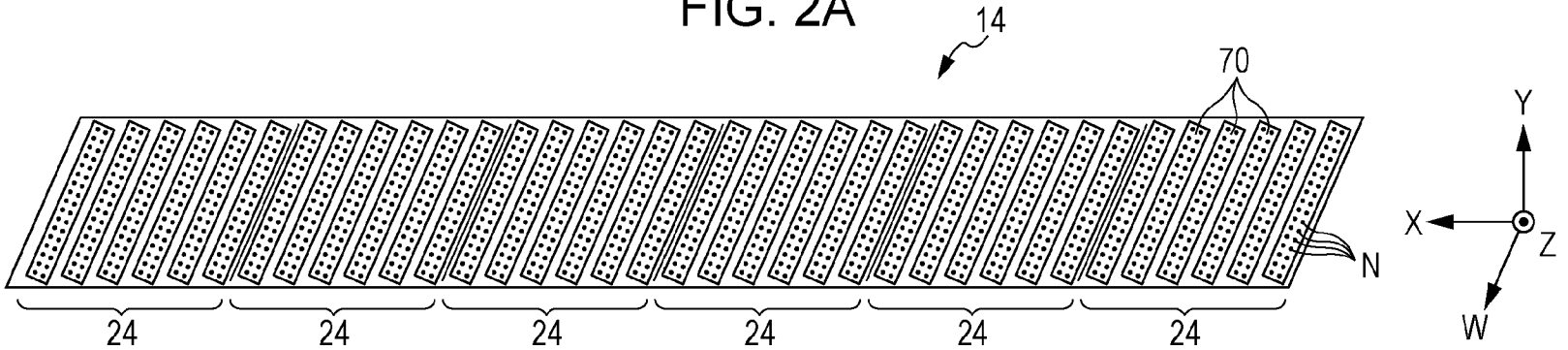
FIGS. 2A and 2B are plan views of a liquid ejecting module.
Figure 2B:
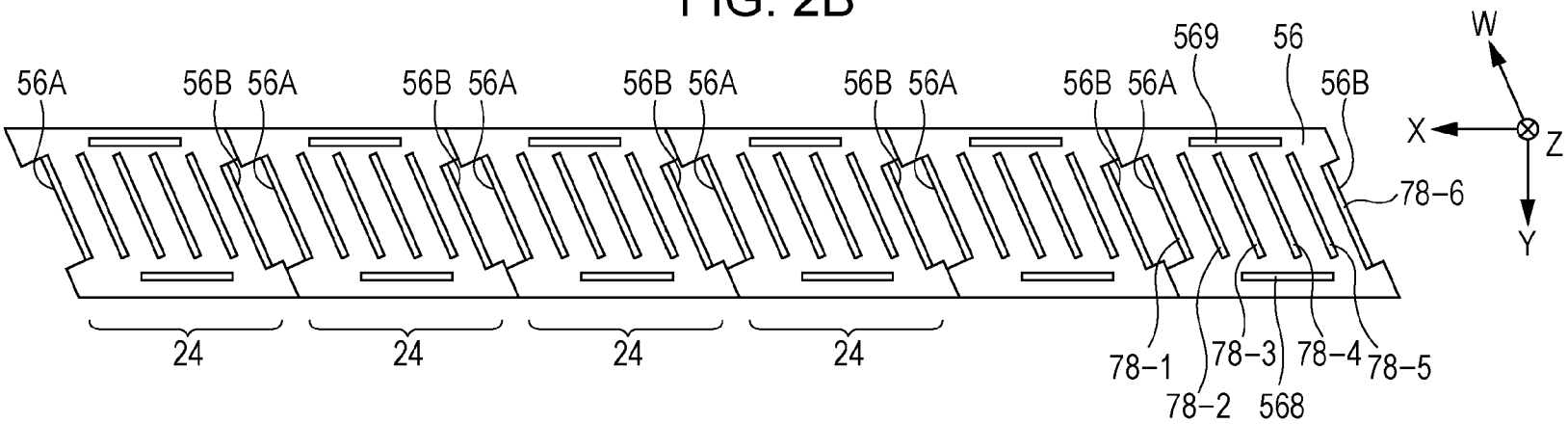

FIG. 2A is a plan view of a face of the liquid ejecting module 14 which faces the printing medium 200, and FIG. 2B is a plan view of the liquid ejecting module 14 on the side opposite to the printing medium 200. As exemplified in FIGS. 2A and 2B, the liquid ejecting module 14 includes six liquid ejecting heads 24. The six liquid ejecting heads 24 are arranged along the X direction. Each liquid ejecting head 24 includes a plurality of (six in FIGS. 2A and 2B) head units 70 which are arranged in the X direction. A plurality of nozzles N are formed in each head unit 70. A plurality of nozzles N of one head unit 70 are arranged in two rows along the W direction which is inclined at a predetermined angle with respect to the X direction and the Y direction. Ink of four systems (four colors) are supplied to each head unit 70 of the liquid ejecting head 24 in parallel. The plurality of nozzles N of one liquid ejecting head 24 are divided into four sets, and eject inks different for each set to the printing medium 200 side.

Figure 3:
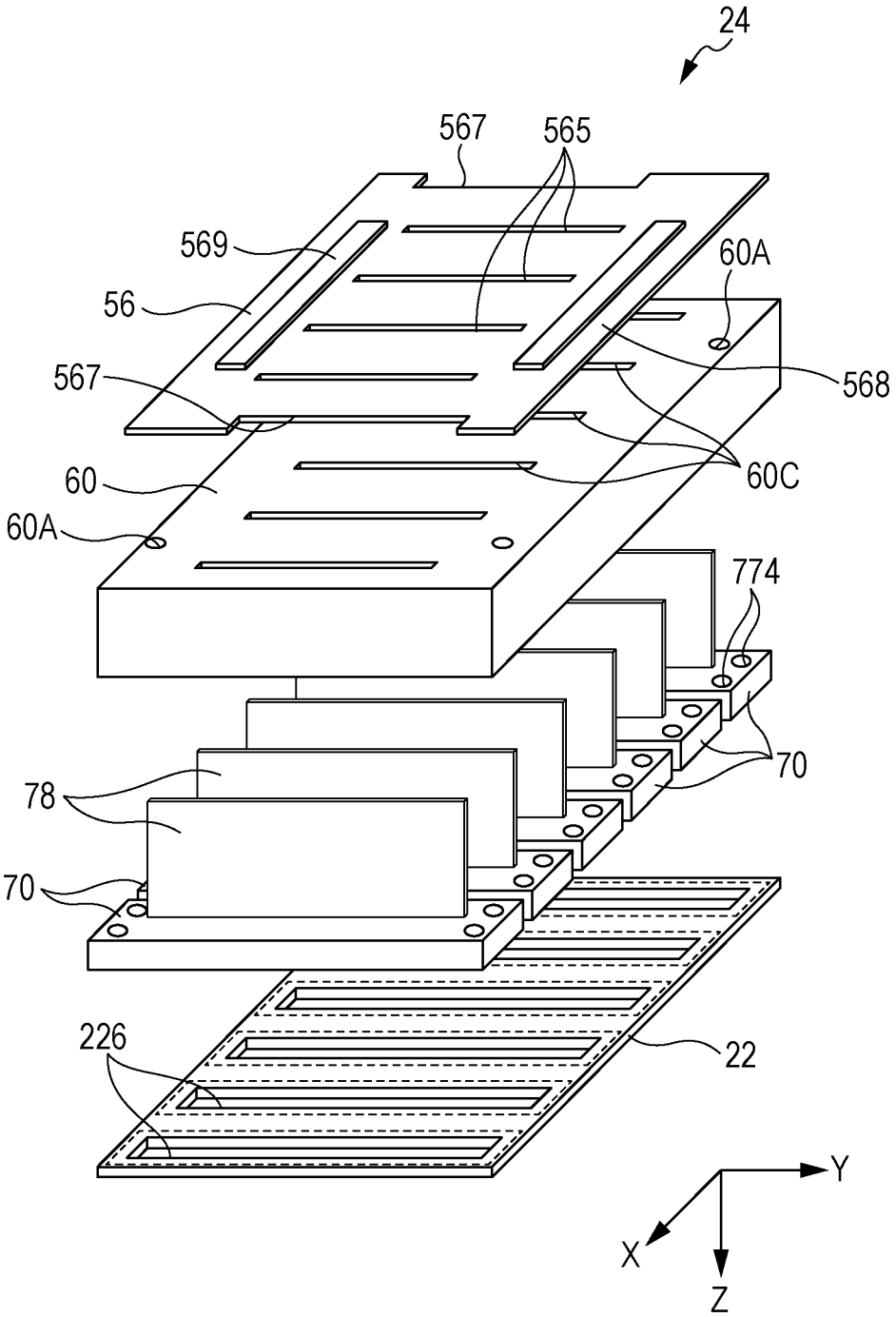
FIG. 3 is an exploded perspective view of a liquid ejecting head.

FIG. 3 is an exploded perspective view of one arbitrary liquid ejecting head 24. As exemplified in FIG. 3, each liquid ejecting head 24 includes a basic wiring board 56, a liquid distribution unit 60, six head units 70, and a fixing plate 22. The liquid distribution unit 60 is arranged between the basic wiring board 56 and the plurality of head units 70. That is, each head unit 70 faces the basic wiring board 56 by interposing the liquid distribution unit 60 therebetween. The fixing plate 22 is bonded to a face on the side opposite to the basic wiring board 56 (face on printing medium 200 side onto which ink is ejected) of the plurality of head units 70.

An individual wiring board 78 is bonded to each of the plurality of head units 70. The individual wiring board 78 is bonded to the basic wiring board 56 by being inserted into an insertion port (slit) 60C which is formed in the liquid distribution unit 60. Each of the individual wiring boards 78 is a flexible wiring board (chip on film (COF)) for electrically connecting the basic wiring board 56 and each of the head units 70. A connection between the individual wiring board 78 and the head unit 70, and a connection between the individual wiring board 78 and the basic wiring board 56 will be described later.

The basic wiring board 56 in FIG. 3 is a board on which wiring for transmitting various control signals, or a power supply voltage to the head unit 70 is formed. The liquid distribution unit 60 is a structure body in which a flow path is formed, and distributes each ink of four systems which is supplied to supply ports 60A which are formed at four portions (four corners) to six systems corresponding to each head unit 70. The fixing plate 22 is a flat plate-shaped member which supports the head unit 70, and is formed of high rigidity metal such as stainless steel, for example. As exemplified in FIG. 3, six opening portions 226 corresponding to head units 70 which are different from each other are formed in the fixing plate 22. Each opening portion 226 is an approximately rectangular through hole which is long in the W direction when planarly viewed.

Figure 4:
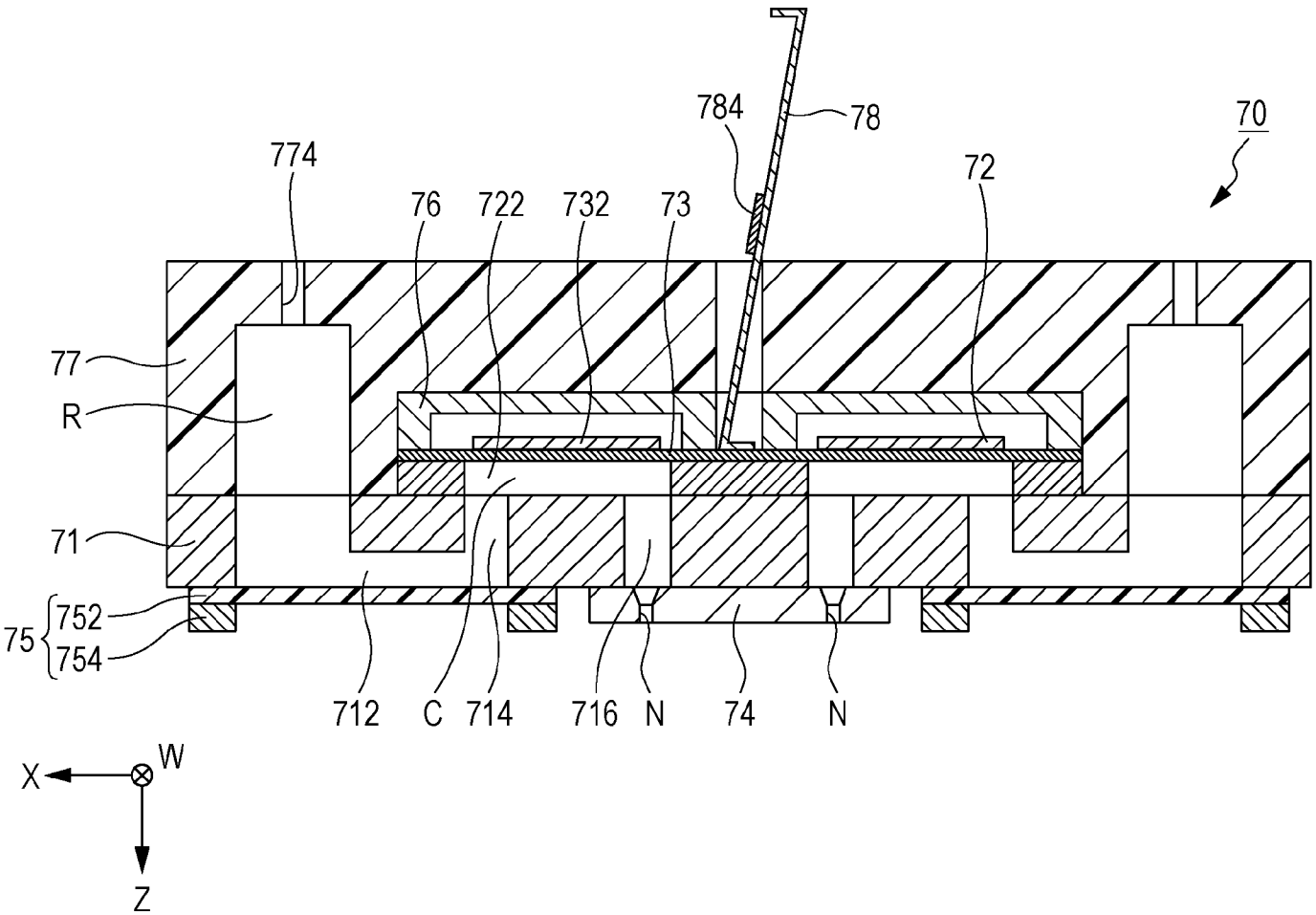
FIG. 4 is a cross-sectional view of a head unit.

FIG. 4 is a cross-sectional view (cross section which is perpendicular to W direction) of one arbitrary head unit 70. As exemplified in FIG. 4, the head unit 70 includes a head chip in which a pressure chamber forming substrate 72 and a vibrating plate 73 are stacked on one surface of a flow path forming substrate 71, and a nozzle plate 74 and a compliance unit 75 are installed on the other surface. The plurality of nozzles N are formed on the nozzle plate 74. Each head unit 70 is fixed to the surface of the fixing plate 22 using an adhesive, for example, in a state in which the nozzle plate 74 is located on the inside of each of opening portions 226. In addition, as understood in FIG. 4, since a structure corresponding to each row of nozzle N is formed approximately line symmetrically in one head unit 70, hereinafter, a structure of the head unit 70 will be described by conveniently focusing on the nozzle N of one row.

The flow path forming substrate 71 is a flat plate member which configures a flow path of ink, and in which an opening portion 712, a supply flow path 714, and a communication flow path 716 are formed. The supply flow path 714 and the communication flow path 716 are formed in each nozzle N, and the opening portions 712 are continuously formed over the plurality of nozzles N which eject ink of one system. The pressure chamber forming substrate 72 is a flat plate member in which a plurality of opening portions 722 corresponding to nozzles N different from each other are formed. The flow path forming substrate 71, or the pressure chamber forming substrate 72 is formed of a silicon single crystal substrate, for example. The compliance unit 75 is a mechanism which suppresses (absorbs) a pressure change in the flow path of the head unit 70, and is configured of a sealing plate 752 and a support body 754. The sealing plate 752 is a flexible film-shaped member, and the support body 754 fixes the sealing plate 752 to the flow path forming substrate 71 so that the opening portion 712 of the flow path forming substrate 71, and each supply flow path 714 are blocked.

The vibrating plate 73 is installed on the surface of the pressure chamber forming substrate 72 in FIG. 4 on the side opposite to the flow path forming substrate 71. The vibrating plate 73 is a flat plate-shaped member which can be elastically vibrated, and is configured by stacking an elastic film which is formed of an elastic material such as silicon oxide, for example, and an insulating film which is formed of an insulating material such as zirconium oxide. As understood in FIG. 4, the vibrating plate 73 and the flow path forming substrate 71 face each other with an interval in the inside of each opening portion 722 which is formed in the pressure chamber forming substrate 72. A space which is interposed between the flow path forming substrate 71 and the vibrating plate 73 in the inside of each opening portion 722 functions as a pressure chamber (cavity) C which applies a pressure to ink.

A plurality of piezoelectric elements 732 corresponding to nozzles N which are different from each other are formed on the surface of the vibrating plate 73 on a side opposite to the pressure chamber forming substrate 72, and an end portion of the individual wiring board 78 (first connection portion 781) is bonded to the surface. The individual wiring board 78 is a flexible wiring board on which wiring for transmitting a driving signal, or a power supply voltage to each piezoelectric element 732 is formed, and is bonded to the basic wiring board 56 by passing through the opening portion (slit) which is formed in a protective plate 76 and a support body 77. As understood from the above descriptions, one end side of the individual wiring board 78 (first connection portion 781 side) is bonded to the vibrating plate 73, and the other end side of the individual wiring board 78 (second connection portion 782 side) is bonded to the basic wiring board 56. Each piezoelectric element 732 is a laminated body in which a piezoelectric body is interposed between electrodes which face each other. A pressure in the pressure chamber C fluctuates, and ink in the pressure chamber C is ejected from the nozzle N when the piezoelectric element 732 vibrates along with the vibrating plate 73 due to a driving signal which is supplied through the basic wiring board 56. Each piezoelectric element 732 is sealed and protected by the protective plate 76 which is fixed to the vibrating plate 73.

As exemplified in FIG. 4, the support body 77 is fixed to the flow path forming substrate 71 and the protective plate 76. The support body 77 is integrally formed by molding a resin material, for example. In the support body 77 according to the embodiment, a space 772 for forming a liquid storing chamber (reservoir) R, and a supply port 774 which communicates with the liquid storing chamber R are formed along with the opening portion 712 of the flow path forming substrate 71. Each supply port 774 communicates with each outlet of the liquid distribution unit 60. Accordingly, ink of each system after being distributed using the liquid distribution unit 60 is supplied and stored in the liquid storing chamber R through the supply port 774 of the head unit 70. The ink stored in the liquid storing chamber R is distributed and supplied into each pressure chamber C using the plurality of supply flow paths 714, and is ejected to the outside (printing medium 200 side) from each pressure chamber C by passing through the communication flow path 716 and the nozzle N.

Figure 5B:
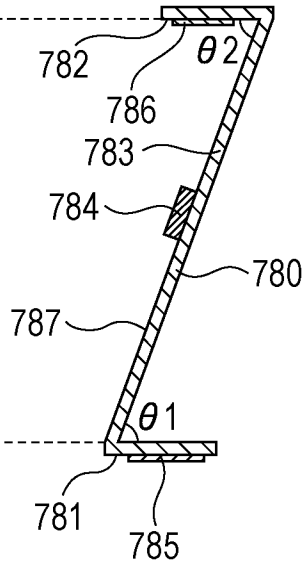
FIG. 5B is a side view thereof.
Figure 5A:
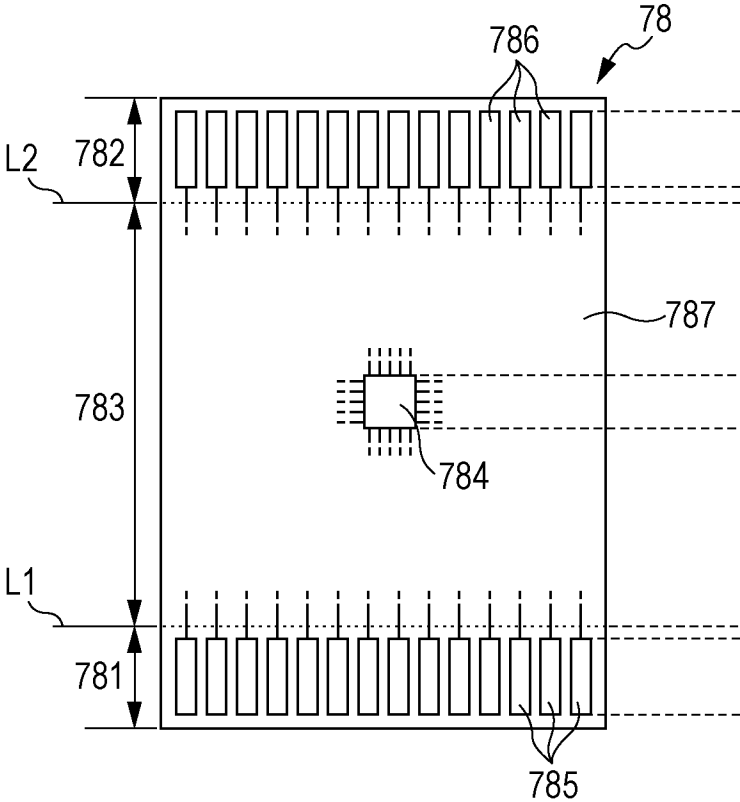
FIG. 5A is a plan view of an individual wiring board.

FIGS. 5A and 5B are a plan view and a side view of the individual wiring board 78. The individual wiring board 78 is a wiring board which electrically connects the basic wiring board 56 and each head unit 70, and is configured of a flexible base 780, and a plurality of wiring which are formed on one surface (hereinafter, referred to as "wiring forming face") 787 of the base 780. Wiring for transmitting a control signal or a power supply voltage which is supplied from the basic wiring board 56 to the head unit 70 is formed on the wiring forming face 787 of the base 780.

The individual wiring board 78 includes a first connection portion 781, a second connection portion 782, and a relay portion 783. As exemplified in FIG. 5A, the first connection portion 781 and the second connection portion 782 are portions which are located at both ends of the individual wiring board 78. That is, in the individual wiring board 78, the relay portion 783 is located between the first connection portion 781 and the second connection portion 782. In FIG. 5A, a boundary L1 between the first connection portion 781 and the relay portion 783, and a boundary L2 between the second connection portion 782 and the relay portion 783 are illustrated.

As illustrated in FIG. 5A, a plurality of terminals 785 which are electrically connected to the head unit 70 (each piezoelectric element 732) are formed on the wiring forming face 787 of the first connection portion 781, and a plurality of terminals 786 which are electrically connected to the basic wiring board 56 are formed on the wiring forming face 787 of the second connection portion 782. In addition, an integrated circuit (IC) chip 784 is mounted on the relay portion 783. The IC chip 784 generates a driving signal of each piezoelectric element 732 using the control signal and the power supply voltage which are supplied from the basic wiring board 56. The driving signal which is generated in the IC chip 784 is supplied to the head unit 70 through a terminal 785.

Figure 6:
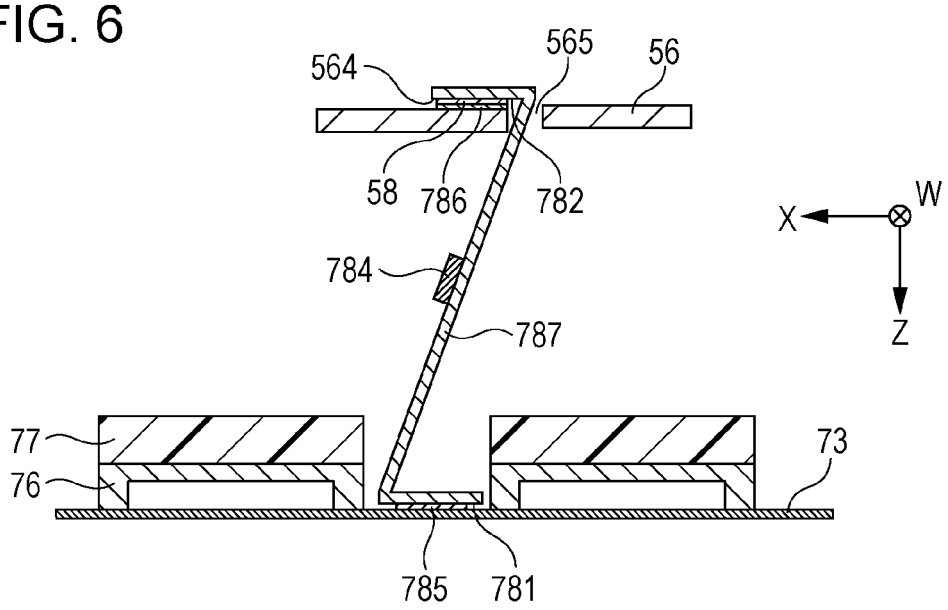
FIG. 6 is an explanatory diagram which illustrates a connection of the individual wiring board to a basic wiring board and the head unit.

As exemplified in FIG. 5B, the individual wiring board 78 according to the embodiment is bent at the boundary L1 so that the first connection portion 781 forms a predetermined angle θ1 with respect to the relay portion 783. In addition, as illustrated in FIG. 6, the terminal 785 which is formed on the wiring forming face 787 of the first connection portion 781, and a connection terminal on the surface of the vibrating plate 73 are arranged in the first connection portion 781 of the individual wiring board 78, and on the vibrating plate 73 of the head unit 70 in a state of being in contact, and are bonded to wiring which is connected to each piezoelectric element 732 each other. That is, the first connection portion 781 is a portion for being in contact with wiring which is connected to the piezoelectric element 732 formed on the vibrating plate 73 in the individual wiring board 78.

Figure 7:
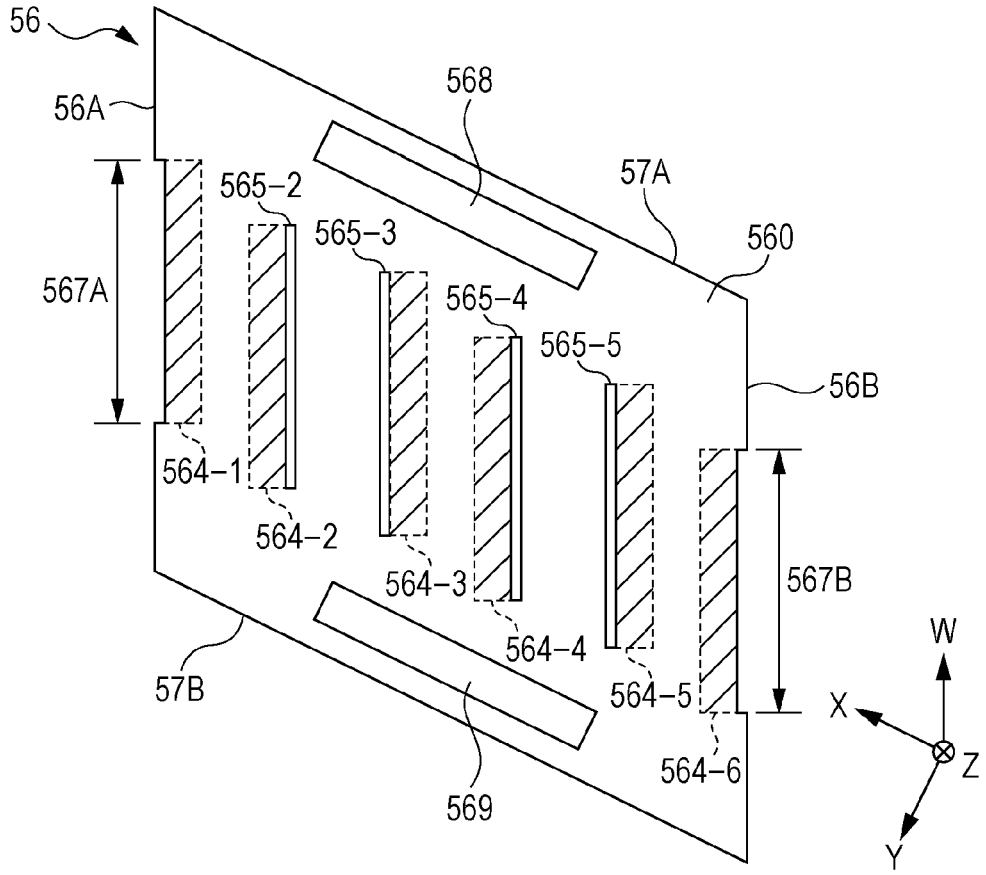
FIG. 7 is a plan view of the basic wiring board.
Figure 8:
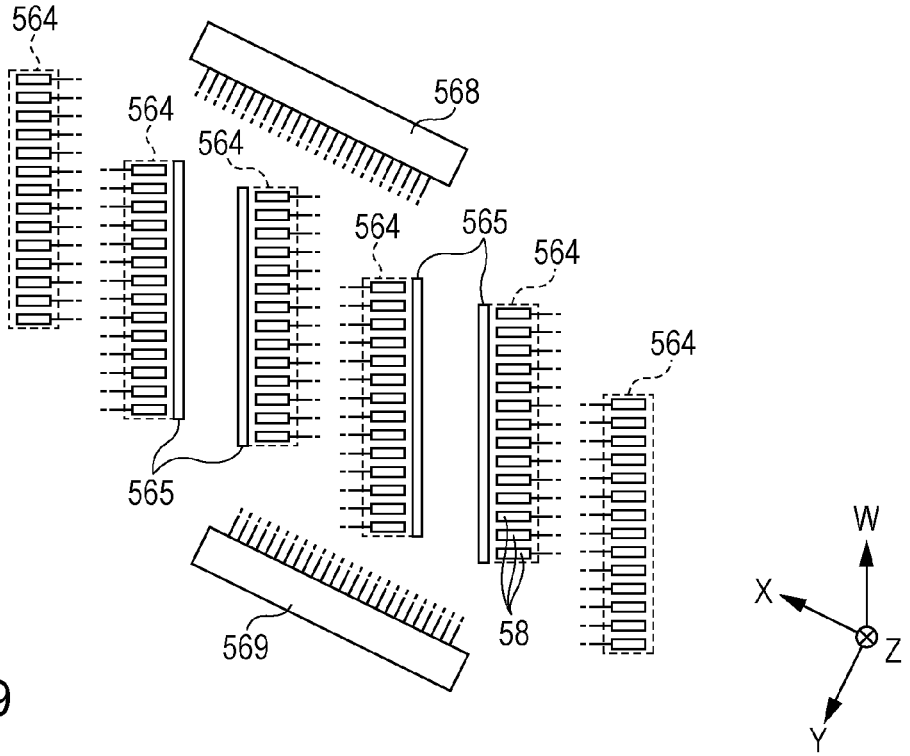
FIG. 8 is an explanatory diagram of wiring and a connector on the basic wiring board.

FIG. 7 is a plan view of the basic wiring board 56. The basic wiring board 56 is a rigid board which is obtained by forming a plurality of wiring on the surface of a flat plate-shaped base 560. The base 560 according to the embodiment is schematically formed in a planar shape (approximately parallelogram shape) which includes outer peripheral edges 56A and 56B which extend along the W direction, and outer peripheral edges 57A and 57B which extend in the X direction. As exemplified in FIG. 8, a plurality of (four) insertion ports 565 (565-2 to 565-5) are formed in the base 560 of the basic wiring board 56 with intervals therebetween. Each insertion port 565 is a through hole (slit) which extends in the W direction. The individual wiring board 78 is inserted into each insertion port 565.

A concave portion 567A is formed in the outer peripheral edge 56A of the basic wiring board 56, and a concave portion 567B is formed in the outer peripheral edge 56B on a side opposite to the outer peripheral edge 56A. Dimensions of the concave portions 567A and 567B in the W direction exceed the horizontal width (full length of boundary L2) of the individual wiring board 78. As exemplified in FIG. 8, a plurality of connection terminals 58 which are arranged in the W direction are formed with intervals therebetween in a region (hereinafter, referred to as "connection region") 564 which extends along each concave portion 567 (567A and 567B), and each insertion port 565 on the surface opposite to each head unit 70, in the base 560 of the basic wiring board 56.

As understood in FIG. 7, a connector 568 which is long in the X direction is installed in a region between the plurality of connection regions 564 and the outer peripheral edge 57A in the base 560. Similarly, a connector 569 which is long in the X direction is installed between the plurality of connection region 564 and the outer peripheral edge 57B in the base 560. As exemplified in FIG. 7, the connection terminal 58 which is formed in each of the plurality of connection regions 564 is electrically connected to the connector 568 or 569 through wiring which is formed on the surface of the base 560.

As exemplified in FIG. 5B, the individual wiring board 78 is bent at the boundary L2 so that the second connection portion 782 forms a predetermined angle θ2 with respect to the relay portion 783. In addition, as exemplified in FIG. 6, the second connection portion 782 of the individual wiring board 78 and the connection region 564 of the basic wiring board 56 are bonded to each other in a state in which a terminal 786 which is formed on the wiring forming face 787 of the second connection portion 782, and the connection terminal 58 which is formed in the connection region 564 come into contact. That is, the second connection portion 782 is a portion which comes into contact with each connection terminal 58 on the surface of the basic wiring board 56 in the individual wiring board 78.

Figure 9:
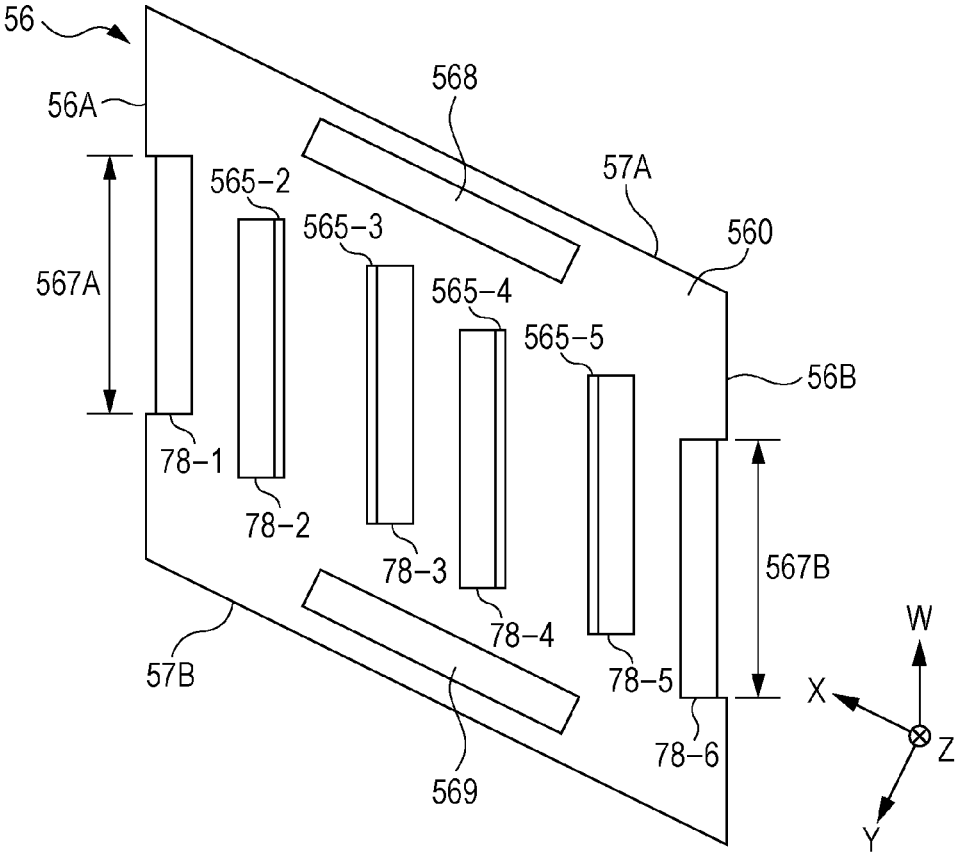
FIG. 9 is a plan view of the basic wiring board in a state in which the individual wiring board is fixed.

FIG. 9 is an explanatory diagram which illustrates bonding between each of six individual wiring boards 78 corresponding to six head units 70 and the basic wiring board 56. In addition, in the following description, when it is necessary to classify each of the plurality of individual wiring boards 78, an Nth (N=1 to 6) individual wiring board 78 from a positive side in the X direction is denoted by an "individual wiring board 78-N". There is a case in which each of the connection regions 564 is classified using the similar subscript "-N".

As understood in FIG. 7, a connection region 564-1 is located on the outer peripheral edge 56B side (inner side) with respect to the outer peripheral edge 56A (concave portion 567A), and a connection region 564-6 is located on the outer peripheral edge 56A side (inner side) with respect to the outer peripheral edge 56B (concave portion 567B). In addition, each even-numbered connection region 564 (564-2, 564-4) is located on the positive side in the X direction with respect to the insertion port 565 along which the connection region 564 extends, and each odd-numbered connection region 564 (564-3, 564-5) is located at the negative side in the X direction with respect to the insertion port 565 along which the connection region 564 extends.

As understood in FIGS. 7 and 9, in an individual wiring board (first individual wiring board) 78-1 which is located at one end portion side (positive side in X direction) in a direction in which six individual wiring boards 78 (78-1 to 78-6) are aligned (X direction), the second connection portion 782 which is bent to the outer peripheral edge 56B side along the outer peripheral edge 56A of the basic wiring board 56 is connected to the connection region 564-1 which extends along the outer peripheral edge 56A. Specifically, the individual wiring board 78-1 is bent at the boundary L2 in the inside of the concave portion 567A of the outer peripheral edge 56A, and the second connection portion 782 is connected to the connection region 564-1 in a state in which the relay portion 783 faces the side face of the base 560. As understood from the above description, the individual wiring board 78-1 is accommodated in the concave portion 567A of the outer peripheral edge 56A.

An individual wiring board (fourth individual wiring board) 78-6 which is located on the other end portion side (negative side in X direction) which is opposite to the individual wiring board 78-1 in the direction (X direction) in which six individual wiring boards 78 (78-1 to 78-6) are aligned is also arranged, similarly to the individual wiring board 78-1. That is, in the individual wiring board 78-6, the second connection portion 782 which is bent to the outer peripheral edge 56A side in the inside of the concave portion 567B along the outer peripheral edge 56B in the basic wiring board 56 is connected to the connection region 564-6.

Each individual wiring board 78 (78-2 to 78-5) at portions other than the end portion in the six individual wiring boards 78 is inserted into the insertion port 565 (565-2 to 565-5) which is formed on the base 560 of the basic wiring board 56, and the second connection portion 782 which is bent along the inner peripheral edge of the insertion port 565 is connected to the connection region 564 of the basic wiring board 56. For example, in the individual wiring board 78-2, the second connection portion 782 which is bent along the inner peripheral edge of the insertion port 565-2 corresponding to the individual wiring board 78-2 is connected to the connection region 564-2.

As described above, each individual wiring board 78 (78-1 to 78-6) which is included in one liquid ejecting head 24 is fixed to the basic wiring board 56. The same is applied to each individual wiring board 78 of another liquid ejecting head 24 which configures the liquid ejecting module 14. As exemplified in FIG. 2B, the plurality of liquid ejecting heads 24 are arranged along the X direction in a state in which the outer peripheral edge 56A of the basic wiring board 56 of each liquid ejecting head 24, and the outer peripheral edge 56B of the basic wiring board 56 of the liquid ejecting head 24 which is neighboring the outer peripheral edge 56A in the positive side in the X direction are close to each other. As described above, the second connection portion 782 of the individual wiring board 78-1 which extends along the outer peripheral edge 56A is bent to the outer peripheral edge 56B side, and the second connection portion 782 of the individual wiring board 78-6 which extends along the outer peripheral edge 56B is bent to the outer peripheral edge 56A side, in each liquid ejecting head 24. According to the above configuration, since it is not necessary to secure a space for wiring on the outside of each of the individual wiring board 78-1 and the individual wiring board 78-6 in the basic wiring board 56, it is possible to sufficiently reduce intervals in arrangement of nozzle N between liquid ejecting heads 24 which are close to each other. That is, it is possible to arrange the plurality of liquid ejecting heads 24 at high density. Accordingly, as understood in FIG. 2B, it is possible to arrange the nozzle N at even intervals in the plurality of liquid ejecting heads 24.

Figure 10:
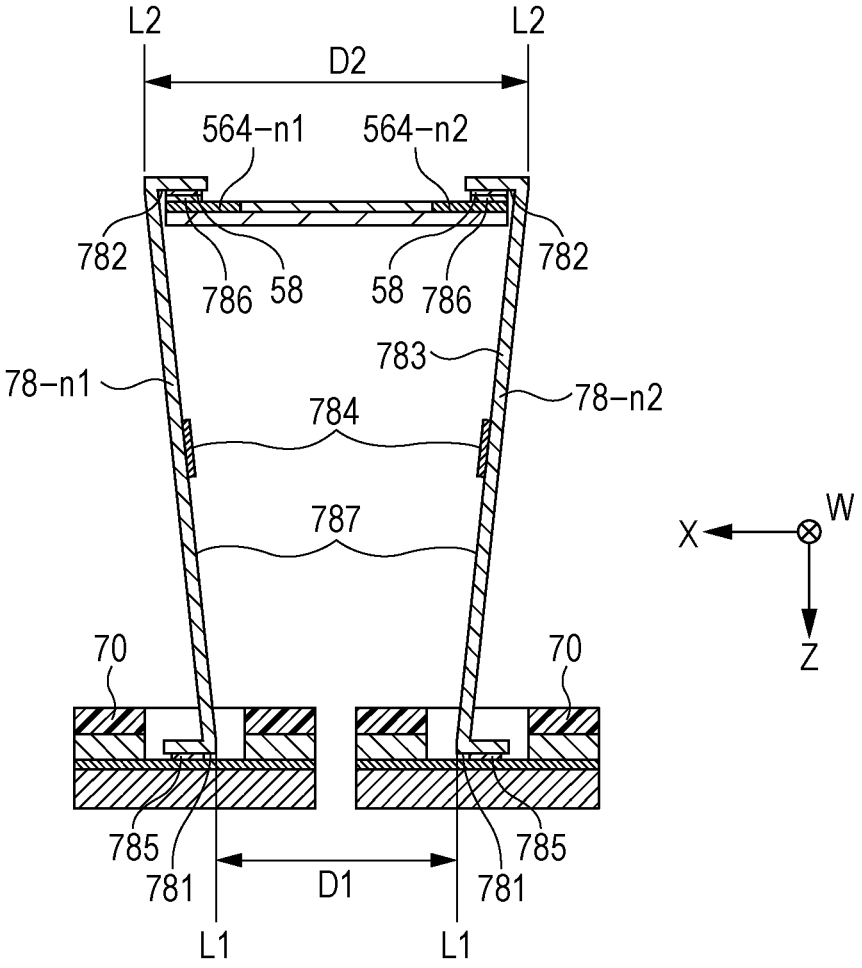
FIG. 10 is an explanatory diagram of two individual wiring boards which form a pair, and are close to each other.

As exemplified in FIG. 10, a relationship between the odd-numbered individual wiring board 78 (hereinafter, referred to as "individual wiring board **78-*n*1") in six individual wiring boards 78 and the individual wiring board 78 neighboring the individual wiring board 78-*n*1 on the negative side in the X direction (hereinafter, referred to as "individual wiring board 78-*n*2) will be described by focusing on their paring off ((n1, n2)=(1, 2), (3, 4), (5, 6)). FIG. 10 is a diagram which illustrates a pair of individual wiring boards 78 which are close to each other when viewed in the W direction. As exemplified in FIG. 10, the first connection portion 781 of the individual wiring board 78-*n*1 is connected to one odd-numbered head unit (first head unit) 70 among six head units, and the first connection portion 781 of the individual wiring board 78-*n*2 is connected to one even-numbered head unit (second head unit) 70. Hereinafter, the connection region 564 (564-1, 564-3, 564-5) to which the individual wiring board 78-*n*1 is connected will be denoted by a "connection region 564-*n*1", and hereinafter, the connection region 564 (564-2, 564-4, 564-6) to which the individual wiring board 78-*n*2 is connected will be denoted by a "connection region 564-*n*2". The connection region 564-*n*1 and the connection region 564-*n*2** are close to each other along the X direction.

As understood in FIG. 10, in the individual wiring board **78-*n*1 (first individual wiring board), the second connection portion 782 which is bent to the connection region 564-*n*2 side with respect to the relay portion 783 is connected to the connection region 564-*n*1 (first connection region) of the basic wiring board 56. On the other hand, in the individual wiring board 78-*n*2 (second individual wiring board), the second connection portion 782 which is bent to the connection region 564-*n*1 side with respect to the relay portion 783 is connected to the connection region 564-*n*2 (second connection region) of the basic wiring board 56. That is, when focusing on the pair of the individual wiring board 78-*n*1 and the individual wiring board 78-*n*2 which are close to each other in the X direction, a tip end portion of the second connection portion 782 of the individual wiring board 78-*n*1, and a tip end portion of the second connection portion 782 of the individual wiring board 78-*n*2** face each other.

In FIG. 10, an interval D1 between the individual wiring board **78-*n*1 and the individual wiring board 78-*n*2 on the head unit 70 side, and an interval D2 between the individual wiring board 78-*n*1 and the individual wiring board 78-*n*2 on the basic wiring board 56 side are illustrated. The interval D1 corresponds to a distance between the boundary L1 between the first connection portion 781 and the relay portion 783 in the individual wiring board 78-*n*1 and the boundary L1 between the first connection portion 781 and the relay portion 783 in the individual wiring board 78-*n*2. On the other hand, the interval D2 corresponds to a distance between the boundary L2 between the second connection portion 782 and the relay portion 783 in the individual wiring board 78-*n*1 and the boundary L2 between the second connection portion 782 and the relay portion 783 in the individual wiring board 78-*n*2. As understood in FIG. 10, the interval D2 exceeds the interval D1 (D2>D1). That is, with regard to the interval between the relay portions 783 in the individual wiring board 78-*n*1 and the individual wiring board 78-*n*2, the interval is large on the basic wiring board 56 side (D2) compared to that on each head unit 70 side (D1). Specifically, the individual wiring board 78-*n*1 and the individual wiring board 78-*n*2 are arranged by being inclined to each other so that an interval of each relay portion 783 becomes large toward the basic wiring board 56 from the head unit 70**.

As understood from the above description, according to the embodiment, the second connection portion 782 of the individual wiring board **78-*n*1 is bent to the connection region 564-*n*2 side, and the second connection portion 782 of the individual wiring board 78-*n*2 is bent to the connection region 564-*n*1 side. That is, a tip end portion of the second connection portion 782 of the individual wiring board 78-*n*1, and a tip end portion of the second connection portion 782 of the individual wiring board 78-*n*2 face each other. According to the above configuration, there is an advantage that it is not necessary to secure a wide space for forming wiring of each individual wiring board 78 in a region which is opposite to the other side by interposing one of the individual wiring board 78-*n*1 and the individual wiring board 78-*n*2 therebetween, in the basic wiring board 56. In addition, the interval D2 between the individual wiring board 78-*n*1 and the individual wiring board 78-*n*2 on the basic wiring board 56 side exceeds the interval D1 between the individual wiring board 78-*n*1 and the individual wiring board 78-*n*2 on each head unit 70 side. Accordingly, when compared to a configuration in which the relay portion 783 in the individual wiring board 78-*n*1, and the relay portion 783 in the individual wiring board 78-*n*2 are parallel to each other (for example, configuration in which relay portions 783 of both individual wiring boards 78-*n*1 and 78-*n*2 extend in direction perpendicular to basic wiring board 56), there is an advantage that it is possible to secure a sufficient space between the connection region 564-*n*1 and the connection region 564-*n*2, regardless of the configuration in which the second connection portions 782 of the individual wiring boards 78-*n*1 and 78-*n*2 face each other, and to miniaturize the liquid ejecting head 24**.

In addition, the second connection portion 782 of the individual wiring board 78-1 is bent to the connection region 564-2 side along the outer peripheral edge 56A, and on the other hand, the second connection portion 782 of the individual wiring board 78-2 is inserted into the insertion port 565-2, and is bent to the connection region 564-1 side along the inner peripheral edge of the insertion port 565. That is, the insertion port 565 of the basic wiring board 56 is not necessary with respect to the individual wiring board 78-1 (78-6). Accordingly, when compared to a configuration in which both the individual wiring boards 78-1 and 78-2 are inserted into the insertion port 565 of the basic wiring board 56, it is possible to reduce the total number of the insertion ports 565 which are to be formed in the basic wiring board 56. Accordingly, there is an advantage that it is possible to maintain mechanical strength of the basic wiring board 56, and to efficiently use a space on the basic wiring board 56.

Manufacturing Method of Liquid Ejecting Head 24

Figure 11:
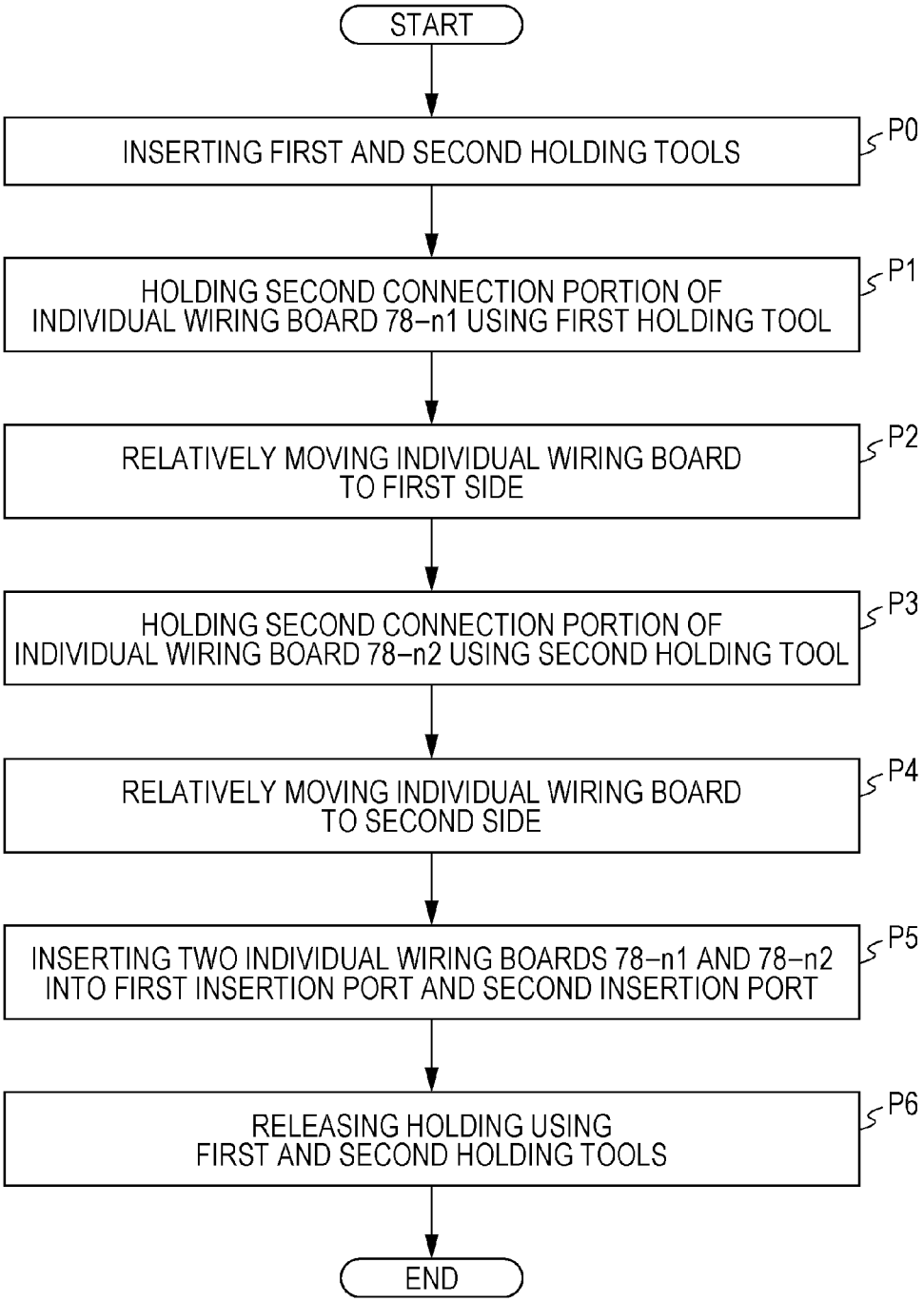
FIG. 11 is a flowchart which describes a process of bonding each individual wiring board to the basic wiring board.

A process of fixing the plurality of individual wiring boards 78 to the basic wiring board 56 in a manufacturing method of the above described liquid ejecting head 24 according to the embodiment will be described. FIG. 11 is a flowchart of the manufacturing method of the liquid ejecting head 24 according to the embodiment. In addition, FIGS. 12 to 18 are explanatory diagrams which illustrate states of the individual wiring board 78 and the basic wiring board 56 in each process by focusing on the individual wiring boards 78-*n*1 and 78-*n*2. In addition, the individual wiring boards 78-1 and 78-6 are bent along the outer peripheral edge (56A and 56B) of the basic wiring board 56 in practice (not inserted into insertion port 565); however, in descriptions and drawings below, a case in which both the individual wiring boards 78-*n*1 and 78-*n*2 are inserted into the insertion port 565 of the basic wiring board 56 will be conveniently exemplified. In addition, the reference plane Q in FIGS. 12 to 18 is a virtual plane which includes a top face of each head unit 70 and is parallel to the basic wiring board 56. Each process in FIG. 11 is started in a state in which each individual wiring board 78 is fixed to the head unit 70.

Figure 12:
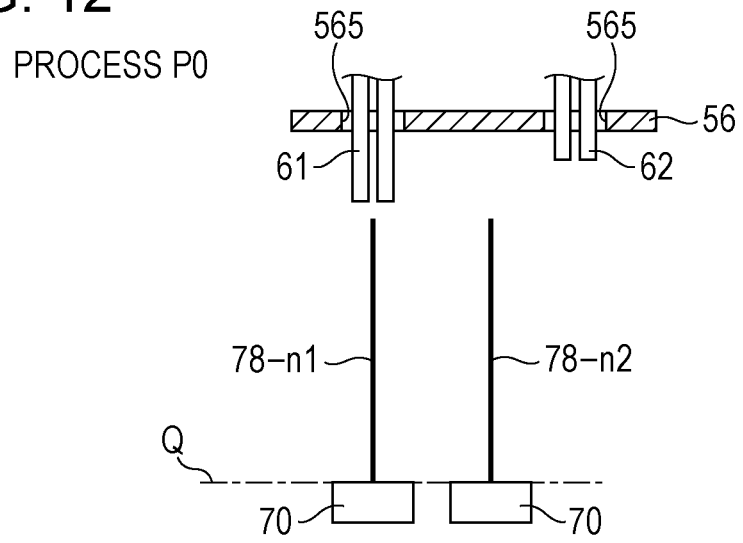
FIG. 12 is an explanatory diagram which describes a process of inserting first and second holding tools into the basic wiring board.

As exemplified in FIG. 12, a first holding tool 61 and a second holding tool 62 are prepared. Each of the first holding tool 61 and the second holding tool 62 is a tool which includes a pair of flat plate members which face each other at approximately regular intervals, and can interpose the individual wiring board 78 between the flat plate members. In the process P0, the first holding tool 61 and the second holding tool 62 are inserted into each insertion port 565 of the basic wiring board 56 from a side opposite to each head unit 70 by interposing the basic wiring board 56 therebetween. As understood in FIG. 12, a tip end of the first holding tool 61 is located on the head unit 70 side (positive side in Z direction) compared to a tip end of the second holding tool 62.

Figure 13:
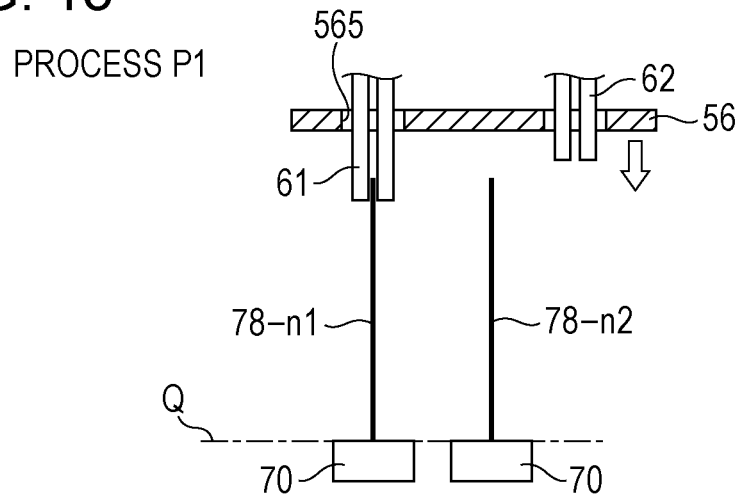
FIG. 13 is an explanatory diagram which describes a process of holding a first individual wiring board using the first holding tool.

In the process P1, as exemplified in FIG. 13, the first holding tool 61 and the second holding tool 62 descend to a positive side in the Z direction along with the basic wiring board 56, and the second connection portion 782 of the individual wiring board 78-*n*1 is held using the first holding tool 61. On the other hand, in the process P1, the second holding tool 62 does not reach the individual wiring board 78-*n*2. That is, the second holding tool 62 does not hold the individual wiring board 78-*n*2.

Figure 14:
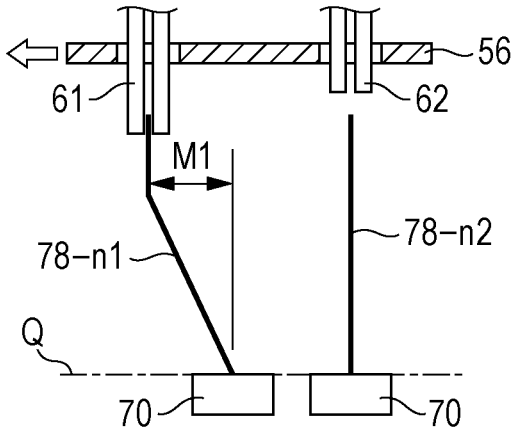
FIG. 14 is an explanatory diagram which describes a process of relatively moving the first individual wiring board to a first side using the first holding tool.

In the process P2, as exemplified in FIG. 14, the first holding tool 61 and the second holding tool 62 are moved to the positive side (hereinafter, referred to as "first side") in a direction in which the plurality of head units 70 are aligned (X direction) along with the basic wiring board 56 in a state in which the second connection portion 782 of the individual wiring board 78-*n*1 is held using the first holding tool 61. Specifically, the first holding tool 61 and the second holding tool 62 are relatively moved by a first movement amount M1 with respect to each head unit 70. Since the second connection portion 782 of the individual wiring board 78-*n*1 is held using the first holding tool 61, the second connection portion 782 of the individual wiring board 78-*n*1 is bent with respect to the relay portion 783 due to a movement of the first holding tool 61 to the first side. As a result of the process P2, the relay portion 783 of the individual wiring board 78-*n*1 is in an inclined state on a side opposite to the individual wiring board 78-*n*2 by an angle corresponding to the movement amount M1 with respect to the reference plane Q. On the other hand, the individual wiring board 78-*n*2 is maintained in a state of being perpendicular to the reference plane Q. In addition, in the above example, the first holding tool 61 and the second holding tool 62 are moved; however, it is also possible to move each head unit 70 with respect to the first holding tool 61 and the second holding tool 62. That is, one of the first and second holding tools 61 and 62 and each head unit 70 is relatively moved with respect to the other. The same is applied to each process which will be described later.

Figure 15:
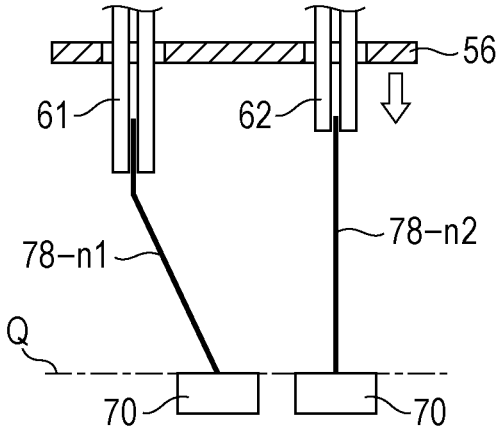
FIG. 15 is an explanatory diagram which describes a process of holding a second individual wiring board using the second holding tool.

In the process P3, as exemplified in FIG. 15, the first holding tool 61 and the second holding tool 62 descend to the positive side in the Z direction from the state in the process P1 along with the basic wiring board 56, and the second connection portion 782 of the individual wiring board 78-*n*1 is held using the second holding tool 62. Holding of the individual wiring board 78-*n*1 using the first holding tool 61 is continuously maintained from the process P2.

Figure 16:
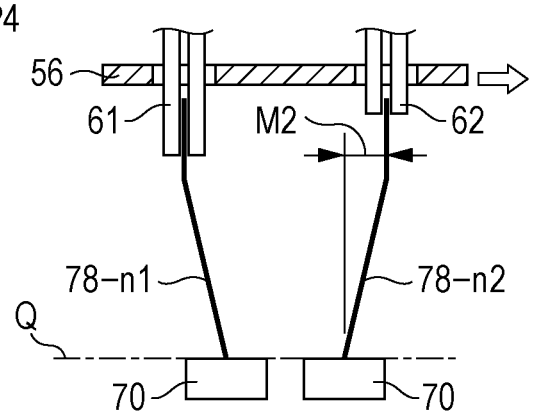
FIG. 16 is an explanatory diagram which describes a process of relatively moving the second individual wiring board to a second side using the second holding tool.

In the process P4, as exemplified in FIG. 16, the first holding tool 61 and the second holding tool 62 are relatively moved by a second movement amount M2 to a negative side (second side which is opposite to first side) in a direction in which the plurality of head units 70 are aligned (X direction) with respect to each head unit 70 along with the basic wiring board 56 in a state in which holding of the individual wiring board 78-*n*1 using the first holding tool 61, and holding of the individual wiring board 78-*n*2 using the second holding tool 62 are maintained. Since the second connection portion 782 of the individual wiring board 78-*n*2 is held using the second holding tool 62, the second connection portion 782 of the individual wiring board 78-*n*2 is bent with respect to the relay portion 783 due to a movement of the second holding tool 62 to the second side. In addition, since holding of the individual wiring board 78-*n*1 using the first holding tool 61 is maintained in the process P4, an angle of inclination of the relay portion 783 of the individual wiring board 78-*n*1 with respect to the reference plane Q is reduced compared to the process P3 due to a movement of the first holding tool 61 to the second side. Specifically, when ending the process P4, the second movement amount M2 is selected so that an angle of inclination of the individual wiring board 78-*n*1 with respect to the reference plane Q, and an angle of inclination of the individual wiring board 78-*n*2 with respect to the reference plane Q become equal to each other. Specifically, the second movement amount M2 in the process P4 is smaller than the first movement amount M1 in the process P2 (M2<M1).

Figure 17:
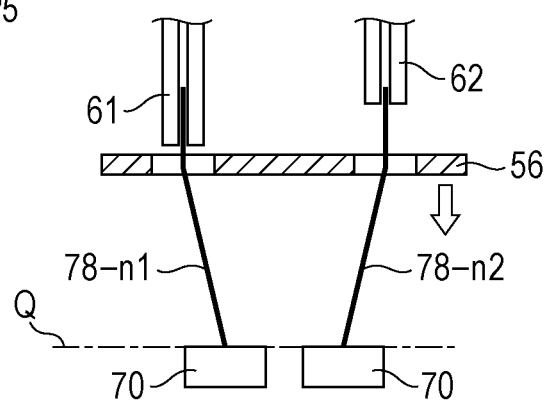
FIG. 17 is an explanatory diagram which describes a process of moving the basic wiring board to the head unit side.

In the process P5, as exemplified in FIG. 17, the respective individual wiring board 78-*n*1 and individual wiring board 78-*n*2 are inserted into each insertion port 565 of the basic wiring board 56 by relatively moving one of the basic wiring board 56 and each head unit 70 to the other so as to be close to each other in a state in which positions of the first holding tool 61 and the second holding tool 62 are maintained similarly to the positions in the process P4.

Figure 18:
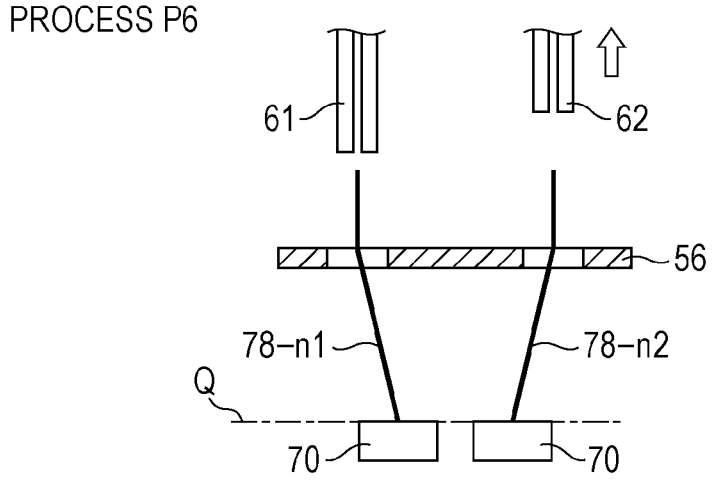
FIG. 18 is an explanatory diagram which describes a process of releasing holding using the first and second holding tools.

In the process P6, as exemplified in FIG. 18, holding of the individual wiring board 78-*n*1 using the first holding tool 61, and holding of the individual wiring board 78-*n*2 using the second holding tool 62 are released. In the above state, each of the second connection portions 782 of the individual wiring board 78-*n*1 and the individual wiring board 78-*n*2 is connected to the basic wiring board 56. Specifically, as described above, the second connection portion 782 of the individual wiring board 78-*n*1 is compressed to the connection region 564-*n*1 in a state of being bent to the connection region 564-*n*2 side, and the second connection portion 782 of the individual wiring board 78-*n*2 is compressed to the connection region 564-*n*2 in a state of being bent to the connection region 564-*n*1 side.

In the above exemplified manufacturing method, after the first holding tool 61 and the second holding tool 62 are relatively moved to the first side with respect to each head unit 70 by the first movement amount M1 in a state in which the individual wiring board 78-*n*1 is held using the first holding tool 61, the first holding tool 61 and the second holding tool 62 are moved to the second side which is a side opposite to the first side by the second movement amount M2, in a state in which the individual wiring board 78-*n*2 is held using the second holding tool 62. Accordingly, it is possible to fix the individual wiring boards 78-*n*1 and 78-*n*2 to the basic wiring board 56 to be inclined to each other so that an interval on the basic wiring board 56 side becomes large (D2>D1) using a simple process.

Modification Example

The above described embodiment can be variously modified. Specific modification examples will be described below. Two or more embodiments which are arbitrarily selected from the examples below can be appropriately merged as far as they are not conflicting with each other.

Figure 19:
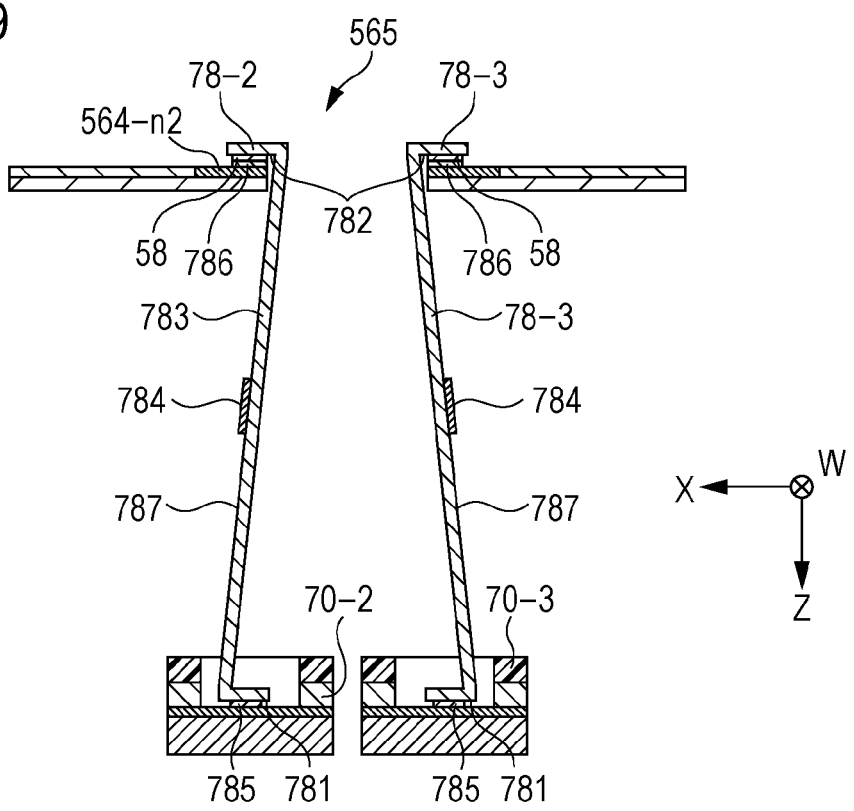
FIG. 19 is a cross-sectional view of an individual wiring board according to a modification example.

(1) In the above described embodiment, a configuration in which one individual wiring board 78 is inserted into one insertion port 565 is exemplified; however, it is also possible to insert a plurality of (two) individual wiring boards 78 into one insertion port 565. FIG. 19 is a configuration diagram of two individual wiring boards 78 (78-2, 78-3) which are close to each other. For example, as exemplified in FIG. 19, the individual wiring board 78-2 and the individual wiring board 78-3 (third individual wiring board) are inserted into a common insertion port 565. In the individual wiring board 78-3, the first connection portion 781 is connected to a third head unit and is inserted into the common insertion port 565 along with the individual wiring board 78-2, and the second connection portion 782 is connected to the basic wiring board 56 by being bent to a side opposite to the individual wiring board 78-2 along the inner peripheral edge on a side opposite to the individual wiring board 78-2 in the insertion port 565. In the configuration in FIG. 19 in which the plurality of individual wiring boards 78 are inserted into the common insertion port 565, there is an advantage that it is possible to maintain mechanical strength of the basic wiring board 56, and to efficiently use a space on the basic wiring board 56, since the total number of the insertion ports 565 to be formed in the basic wiring board 56 is reduced. On the other hand, in the configuration of the embodiment (FIG. 9) in which each individual wiring board 78 (78-2 to 78-5) is inserted into a separate insertion port 565, there is an advantage that contact (collision) of each individual wiring board 78 is prevented.

(2) In the above described embodiment, due to a configuration in which the individual wiring board 78-1 and the individual wiring board 78-6 are bent along the outer peripheral edge (56A, 56B) of the basic wiring board 56, it is not necessary to form the insertion port 565 corresponding to the respective individual wiring boards; however, it is also possible to bond the second connection portion 782 to the connection region 564 after inserting the individual wiring board 78-1 and the individual wiring board 78-6 into the insertion port 565 which is formed in the basic wiring board 56, similarly to other individual wiring boards 78 (78-2 to 78-5).

(3) In the above described embodiment, a single layer wiring board in which wiring or connection terminals (785, 786) are formed on one wiring forming face 787 of the base 780 of the individual wiring board 78 is exemplified; however, it is also possible to use a multilayer wiring board in which wiring or connection terminals are formed on both faces of the base 780, and are electrically connected to each other through a through hole of the base 780 as the individual wiring board 78. However, when adopting the configuration in which the individual wiring board 78 of the single layer is used as the above described embodiment, there is an advantage that it is possible to reduce a manufacturing cost of the liquid ejecting head 24.

(4) In the above described embodiment, the individual wiring board 78 is bent at the boundary L1 between the first connection portion 781 and the relay portion 783; however, a position of bending of the individual wiring board 78 is not limited to the above described example. For example, it is also possible to bend a portion of the individual wiring board 78 on the first connection portion 781 side along a straight line which is parallel to the boundary L1 (that is, straight line separate from boundary L1) in the relay portion 783. Similarly, in the above described embodiment, the individual wiring board 78 is bent at the boundary L2 between the second connection portion 782 and the relay portion 783; however, for example, it is also possible to bend a portion of the individual wiring board 78 on the second connection portion 782 side along a straight line which is parallel to the boundary L2 (that is, straight line separate from boundary L2) in the relay portion 783. As understood from the above described example, a difference in bent line of the individual wiring board 78 with the boundary L1 between the first connection portion 781 and the relay portion 783, and a difference in bent line of the individual wiring board 78 with the boundary L2 between the second connection portion 782 and the relay portion 783 are not important in the embodiment of the invention. In addition, in the above description, a configuration in which the individual wiring board 78 is bent in an angular shape is exemplified; however, it is also possible to bend the individual wiring board 78 in a curved face shape (circular arc face shape).

(5) In the above described embodiment, the portion of the individual wiring board 78 which comes into contact with wiring on the face of the vibrating plate 73 is exemplified as the first connection portion 781, and the portion of the individual wiring board 78 which comes into contact with each connection terminal 48 on the surface of the basic wiring board 56 is exemplified as the second connection portion 782; however, the first connection portion 781 and the second connection portion 782 are not limited to the above described example. For example, it is also possible to adopt a configuration in which a portion of the individual wiring board 78 which faces the surface of the vibrating plate 73 (region on end portion side when viewed from bent line on vibrating plate 73 side) is set to the first connection portion 781, or a configuration in which a portion of the individual wiring board 78 which faces the surface of the basic wiring board 56 (region on end portion side when viewed from bent line on basic wiring board 56 side) is set to the second connection portion 782. In the configuration in which the portion of the individual wiring board 78 which faces the surface of the vibrating plate 73 is set to the first connection portion 781, it is also possible to cause only a part of the first connection portion 781 to come into contact with wiring on the surface of the vibrating plate 73. In addition, in the configuration in which the portion of the individual wiring board 78 which faces the surface of the basic wiring board 56 is set to the second connection portion 782, it is also possible to cause only a part of the second connection portion 782 to come into contact with each connection terminal 48 on the surface of the basic wiring board 56. As understood from the above description, the first connection portion 781 and the second connection portion 782 of the individual wiring board 78 are not limited to regions which are defined by a relationship between wiring and a terminal of a connection target.

Figure 20:
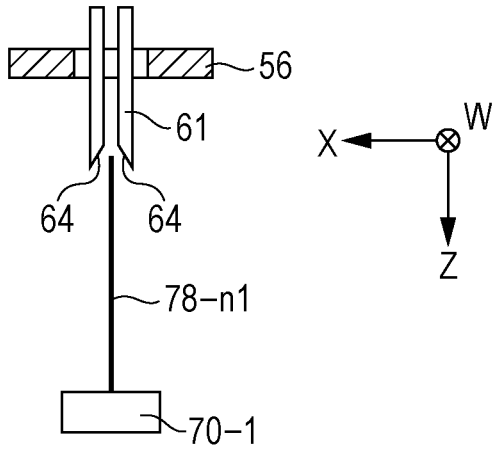
FIG. 20 is an explanatory diagram which describes a process of holding the first individual wiring board using a first holding tool in which a guiding unit is formed.

(6) In the above described embodiment, the holding tool (61 and 62) with a configuration in which a pair of flat plate members are arranged in parallel with an interval therebetween is exemplified; however, the configuration of the holding tool is not limited to the above described example. For example, as exemplified in FIG. 20, it is also possible to form a guiding unit 64 in which an interval into which the individual wiring board 78 is inserted is enlarged in a tapered shape toward a tip end on a tip end side of each holding tool (first holding tool 61 and second holding tool 62). That is, the guiding unit 64 is configured of an inclined face which is formed on a tip end side of the pair of flat plate member which configures the holding tool.

Figure 21A:
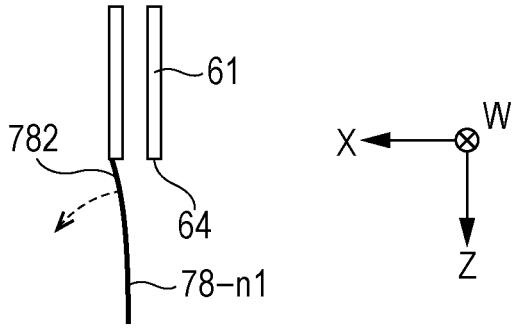
FIGS. 21A and 21B are explanatory diagrams which describe an effect obtained by using the guiding unit.
Figure 21B:
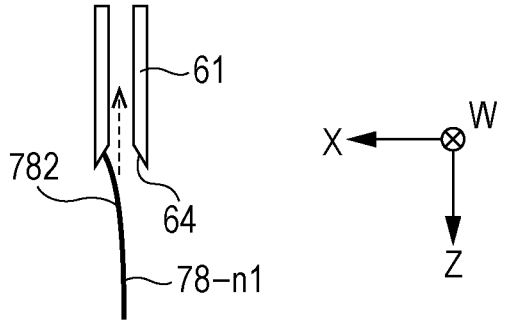

In a configuration in which the guiding unit 64 is not formed in the holding tool, for example, as exemplified in FIG. 21A, there is a possibility that the individual wiring board 78 may collide with a tip end face of the holding tool when the individual wiring board 78 is bent due to its own weight, for example, and the individual wiring board 78 may not be appropriately held using the holding tool. In the configuration in which the guiding unit 64 is formed in the holding tool as exemplified in FIGS. 20A and 20B, as illustrated using a dashed arrow in FIG. 21B, even when the individual wiring board 78 is bent due to its own weight, for example, the individual wiring board 78 is guided to an interval between the pair of flat plate members along the inclined face of the guiding unit 64. Accordingly, there is an advantage that it is possible to easily hold the individual wiring board 78 using the holding tool.

(7) An element which changes a pressure in the pressure chamber C (pressure generation element) is not limited to the piezoelectric element 732. For example, it is also possible to use an oscillating body such as an electrostatic actuator as the pressure generation element. In addition, the pressure generation element is not limited to an element which provides mechanical vibration to the pressure chamber C. For example, as the pressure generation element, it is also possible to use a heating element (heater) which changes a pressure in the pressure chamber C by generating bubbles in the inside of the pressure chamber C using heating. That is, the pressure generation element is included as an element which changes a pressure in the inside of the pressure chamber C, and a method of changing a pressure (piezo method/thermal method), or a specific configuration does not matter.

(8) The printing apparatus 100 which is exemplified in the above described embodiment can be adopted in various devices such as a fax machine, or a copy machine, in addition to a device which is exclusive to printing. Originally, a usage of the liquid ejecting apparatus according to the embodiment of the invention is not limited to printing. For example, a liquid ejecting apparatus which ejects solution of a coloring material can be used as a manufacturing device which forms a color filter of a liquid crystal display device. In addition, a liquid ejecting apparatus which ejects solution of a conductive material is used as a manufacturing device which forms wiring or an electrode of a wiring board.

What is claimed is:

1. A liquid ejecting head comprising:

a basic wiring board which includes a first connection region and a second connection region which extend in a first direction with an interval therebetween;

a plurality of head units which face the basic wiring board, and eject liquid on a side opposite to the basic wiring board; and a plurality of flexible individual wiring boards each of which includes a first connection portion, a second connection portion, and a relay portion which is located between the first connection portion and the second connection portion, and electrically connects the basic wiring board and each of the head units, wherein, in a first individual wiring board among the plurality of individual wiring boards, the first connection portion is connected to a first head unit among the plurality of head units, the second connection portion which is bent to the second connection region side with respect to the relay portion is connected to the first connection region of the basic wiring board, wherein, in a second individual wiring board among the plurality of individual wiring boards, the first connection portion is connected to a second head unit among the plurality of head units, and the second connection portion which is bent to the first connection region side with respect to the relay portion is fixed to the second connection region of the basic wiring board, and wherein an interval between a boundary between the second connection portion and the relay portion in the first individual wiring board, and a boundary between the second connection portion and the relay portion in the second individual wiring board exceeds an interval between a boundary between the first connection portion and the relay portion in the first individual wiring board, and a boundary between the first connection portion and the relay portion in the second individual wiring board.

2. The liquid ejecting head according to claim 1, wherein, in the first individual wiring board, the second connection portion which is bent to the basic wiring board side along an outer peripheral edge of the basic wiring board is connected to the first connection region of the basic wiring board, and wherein, in the second individual wiring board, the second connection portion which is inserted into an insertion port which is formed on the basic wiring board, and is bent along an inner peripheral edge of the insertion port is connected to the second connection region of the basic wiring board.

3. The liquid ejecting head according to claim 2, wherein, in a third individual wiring board which is located on a side opposite to the first individual wiring board by interposing the second individual wiring board among the plurality of individual wiring boards therebetween, the first connection portion is connected to a third head unit among the plurality of head units, and the second connection portion which is inserted into another insertion port which is formed on the basic wiring board separately from the insertion port, and is bent to a side opposite to the second individual wiring board along an inner peripheral edge of another insertion port is connected to the basic wiring board.

4. A liquid ejecting apparatus comprising:

the liquid ejecting head according to claim 3.

5. The liquid ejecting head according to claim 2, wherein, in a third individual wiring board which is located on a side opposite to the first individual wiring board by interposing the second individual wiring board among the plurality of individual wiring boards therebetween, the first connection portion is connected to a third head unit among the plurality of head units, and the second connection portion which is inserted into the insertion port which is common to that of the second individual wiring board, and is bent to the side opposite to the second individual wiring board along an inner peripheral edge of the insertion port on the side opposite to the second individual wiring board is connected to the basic wiring board.

6. A liquid ejecting apparatus comprising:

the liquid ejecting head according to claim 5.

7. A liquid ejecting apparatus comprising:

the liquid ejecting head according to claim 2.

8. The liquid ejecting head according to claim 1, wherein, in the first individual wiring board which is located on one end portion side in a direction in which the plurality of individual wiring boards are aligned, the second connection portion which is bent along a first outer peripheral edge of the basic wiring board is connected to the first connection region of the basic wiring board, and in a fourth individual wiring board which is located on the other end portion side in the direction in which the plurality of individual wiring boards are aligned, the second connection portion which is bent to the first outer peripheral edge side along a second outer peripheral edge on a side opposite to the first outer peripheral edge of the basic wiring board is connected to a connection region of the basic wiring board.

9. The liquid ejecting head according to claim 8, wherein a concave portion for accommodating the first individual wiring board is formed in the first outer peripheral edge.

10. A liquid ejecting apparatus comprising:

the liquid ejecting head according to claim 9.

11. A liquid ejecting apparatus comprising:

the liquid ejecting head according to claim 8.

12. A liquid ejecting apparatus comprising:

the liquid ejecting head according to claim 1.

13. A liquid ejecting head comprising:

a basic wiring board which includes a plurality of connection regions which extend in a first direction with intervals therebetween;

a plurality of head units which face the basic wiring board, and eject liquid on a side opposite to the basic wiring board; and a plurality of flexible individual wiring boards each of which includes a first connection portion, a second connection portion, and a relay portion which is located between the first connection portion and the second connection portion, and electrically connects the basic wiring board and each of the head units, wherein, in a first individual wiring board which is located on one end portion side in a direction in which the plurality of individual wiring boards are aligned, the second connection portion which is bent along a first outer peripheral edge of the basic wiring board is connected to a first connection region of the basic wiring board, and in a fourth individual wiring board which is located on the other end portion side in the direction in which the plurality of individual wiring boards are aligned, the second connection portion which is bent to the first outer peripheral edge side along a second outer peripheral edge on a side opposite to the first outer peripheral edge of the basic wiring board is connected to a connection region of the basic wiring board.

14. A liquid ejecting apparatus comprising:

the liquid ejecting head according to claim 13.

15. A manufacturing method of a liquid ejecting head, comprising:

holding a second connection portion of a first individual wiring board using a first holding tool from a side opposite to a plurality of head units by interposing a basic wiring board therebetween;

relatively moving the basic wiring board by a first movement amount to a first side in a direction in which the plurality of head units are aligned in a state in which the second connection portion of the first individual wiring board is held using the first holding tool;

holding a second connection portion of a second individual wiring board using a second holding tool from a side opposite to the plurality of head units by interposing the basic wiring board therebetween after the basic wiring board is relatively moved;

relatively moving the basic wiring board by a second movement amount which is smaller than the first movement amount to a second side which is opposite to the first side in a direction in which the plurality of head units are aligned, in a state in which the second connection portion of the first individual wiring board is held using the first holding tool, and the second connection portion of the second individual wiring board is held using the second holding tool;

causing the basic wiring board and the plurality of head units to be close to each other; and connecting each of the second connection portions of the first individual wiring board and the second individual wiring board to the basic wiring board by releasing holding using the first and second holding tools, after causing the basic wiring board and the plurality of head units to be close to each other.

16. The manufacturing method of the liquid ejecting head according to claim 15, wherein a guiding unit of which an interval into which the first individual wiring board is inserted becomes large toward a tip end of the first holding tool is formed on the tip end side.

* * * * *